United States Patent [19]

Britton

[11] Patent Number: 4,881,011

[45] Date of Patent: Nov. 14, 1989

[54] CONTROL GEAR FOR HIGH INTENSITY GAS DISCHARGE LIGHTING

[75] Inventor: John Britton, Gnosall, Great Britain

[73] Assignees: Valor International Ltd.; HBH Equipment Ltd., both of London, England

[21] Appl. No.: 110,910

[22] Filed: Oct. 21, 1987

[30] Foreign Application Priority Data

Oct. 22, 1986 [GB] United Kingdom ..... 8625329

[51] Int. Cl.[4] ..... H05B 41/36

[52] U.S. Cl. ..... 315/209 SC; 315/289

[58] Field of Search ..... 315/289, 290, 209 SC, 315/247, 100

[56] References Cited

U.S. PATENT DOCUMENTS

| | | | |
|---|---|---|---|
| 3,551,736 | 12/1970 | Doehner | 315/100 |
| 3,999,100 | 12/1976 | Dendy et al. | 315/308 |
| 4,398,129 | 8/1983 | Logan | 315/208 |
| 4,426,603 | 1/1984 | Mustoe | 315/289 |
| 4,506,195 | 3/1985 | Elms | 315/247 |
| 4,587,460 | 5/1986 | Murayama et al. | 315/174 |

*Primary Examiner*—Robert L. Griffin
*Assistant Examiner*—T. Salindong
*Attorney, Agent, or Firm*—Fleit, Jacobson, Cohn, Price, Holman & Stern

[57] ABSTRACT

A control gear for a high intensity discharge lamp comprising a switch element, and an oscillator connected to drive the switch element through the intermediary of a variable mark-space ratio driver arrangement. The switch element switches current in a series resonant circuit including the primary winding of a transformer, across the secondary winding of which the lamp is connected. A feedback circuit which receives signals controls the mark-space ratio to regulate the power consumed by the lamp in a closed loop. Initially, the mark-space ratio is set at a starting level such that a very high voltage is generated in the resonant circuit to cause starting of the lamp.

20 Claims, 6 Drawing Sheets

CONTROL GEAR FOR HIGH INTENSITY GAS DISCHARGE LIGHTING

This invention relates to control gear for high intensity gas discharge lighting.

Conventional control gear makes use of inductive components which, when the gear is operated at a.c. mains frequency, as is conventional, are of considerable bulk and weight and, furthermore, give rise to substantial energy losses.

Whilst various high frequency switching techniques have been suggested for discharge lamps in general, it has not been considered possible to apply such techniques to the higher power, high intensity discharge lamps, because of problems with mains waveform distortion and radio frequency interference which can arise with conventional high frequency switch-mode power supplies.

It is accordingly an object of the invention to provide a control gear for a high intensity discharge lamp which benefits from the reduction in size and weight of the inductive components and increased efficiency available from high frequency operation without suffering from the problems mentioned above.

In accordance with the invention there is provided a control gear for a high intensity gas discharge lighting tube, comprising an oscillator, a high speed switching element driven by said oscillator, a transformer having its primary winding connected in a series resonant circuit tuned to the frequency of the oscillator and controlled by the switching element and means for connecting the secondary winding of the transformer to the lighting tube.

With such an arrangement, the series resonant circuit including the primary winding of the transformer ensures that the switching transients normally obtained from the use of conventional switch mode power supplies are avoided, thereby avoiding mains waveform distortion and radio frequency interference.

Preferably said switching element is connected across a capacitor which forms a part of said series resonant circuit.

Preferably, the switch device is a gate turn-off thyristor.

Preferably also, a drive circuit is interposed between the switching device and the oscillator and includes means for controlling the mark-space i.e., duty cycle ratio of the drive signals applied to the switching device.

The mark-space ratio control preferably includes means to set the mark-space ratio at about unity initially so as to provide a very high amplitude signal from the series tuned circuit, whereby a high voltage is provided across the lamp for causing initial ionisation of the gas therein.

Such mark-space ratio control may include a feedback circuit connected to the transformer secondary winding and sensitive to the power supplied to the lighting tube.

The transformer preferably comprises a core which fully contains the primary and secondary windings. The core may comprise a sleeve part and a spool-shaped part fitted within the sleeve part, both parts being formed of bonded iron powder.

Figure 1:
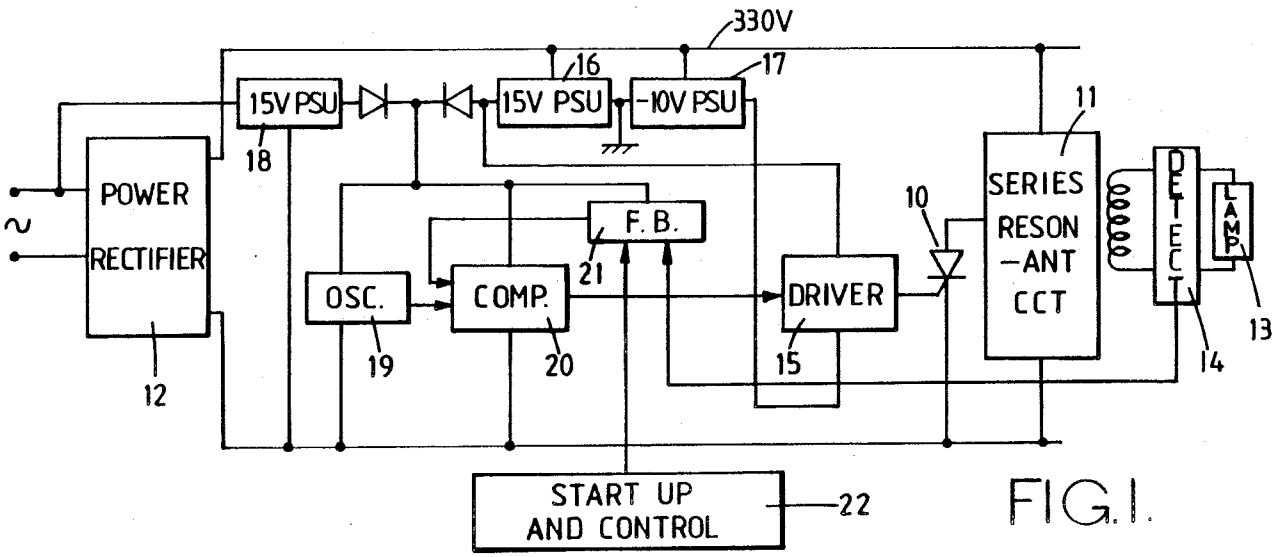
FIG. 1 is a block diagram of an example of a control gear in accordance with the invention.
Figure 2:
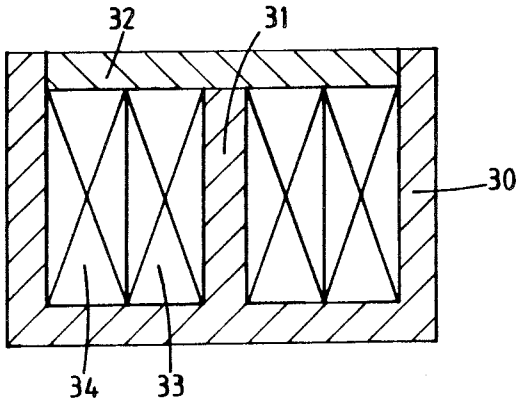
FIG. 2 is a diagrammatic sectional view of a transformer used in the control gear of FIG. 1.

Referring firstly to FIG. 1, the control gear shown makes use of a switching device in the form of a gate turn-off thyristor 10 to control current in the primary winding of a transformer, the primary winding of which is connected in a series resonant circuit 11 across a rectified mains supply provided by a main power rectifier 12. The secondary winding of the transformer has the lamp 13 connected across it and there is a power detector circuit 14 connected in circuit with the lamp 13.

A driver circuit 15 for the GTO 10 is supplied by two switch mode power supply units 16, 17 providing +15 V d.c. and −10 V d.c. respectively. Another 15 V supply 18 derives power directly from the mains input and provides current to an oscillator 19 which switches the input to the driver 15 through the intermediary of a comparator circuit 20 providing a variable mark-space i.e., duty cycle ratio to the driver 15. The detector 14 and a feedback circuit 21 are arranged to vary the reference voltage supplied to the comparator 20 so as, in use, to ensure that the lamp 13 is driven at a predetermined power level. A start-up and control circuit 22 also controls the comparator 20 via the circuit 21 as will be explained in more detail hereinafter.

The main transformer which provides current to the lamp includes a core moulded from resin-bonded iron powder. Preferably hydrogen-reduced iron powder in a conventional polyester resin is used, the iron powder representing about 80% of the weight of the mixture.

The transformer core basically comprises a main moulding consisting of an outer sleeve 30, a disc and a spigot 31. The moulded part is dip-varnished to avoid the need for an insulating spool and the primary winding 33 and the secondary windings of the transformer are wound and then dropped on to the spigot. The core is completed by a layer 32 of the iron containing resin formed in situ. The secondary winding 34 is wound on the outside of the primary winding. One suitable transformer has an outer diameter of about 40 mm, a length of about 30 mm, a primary winding of 80 turns and a secondary winding of 180 turns.

Figure 3:
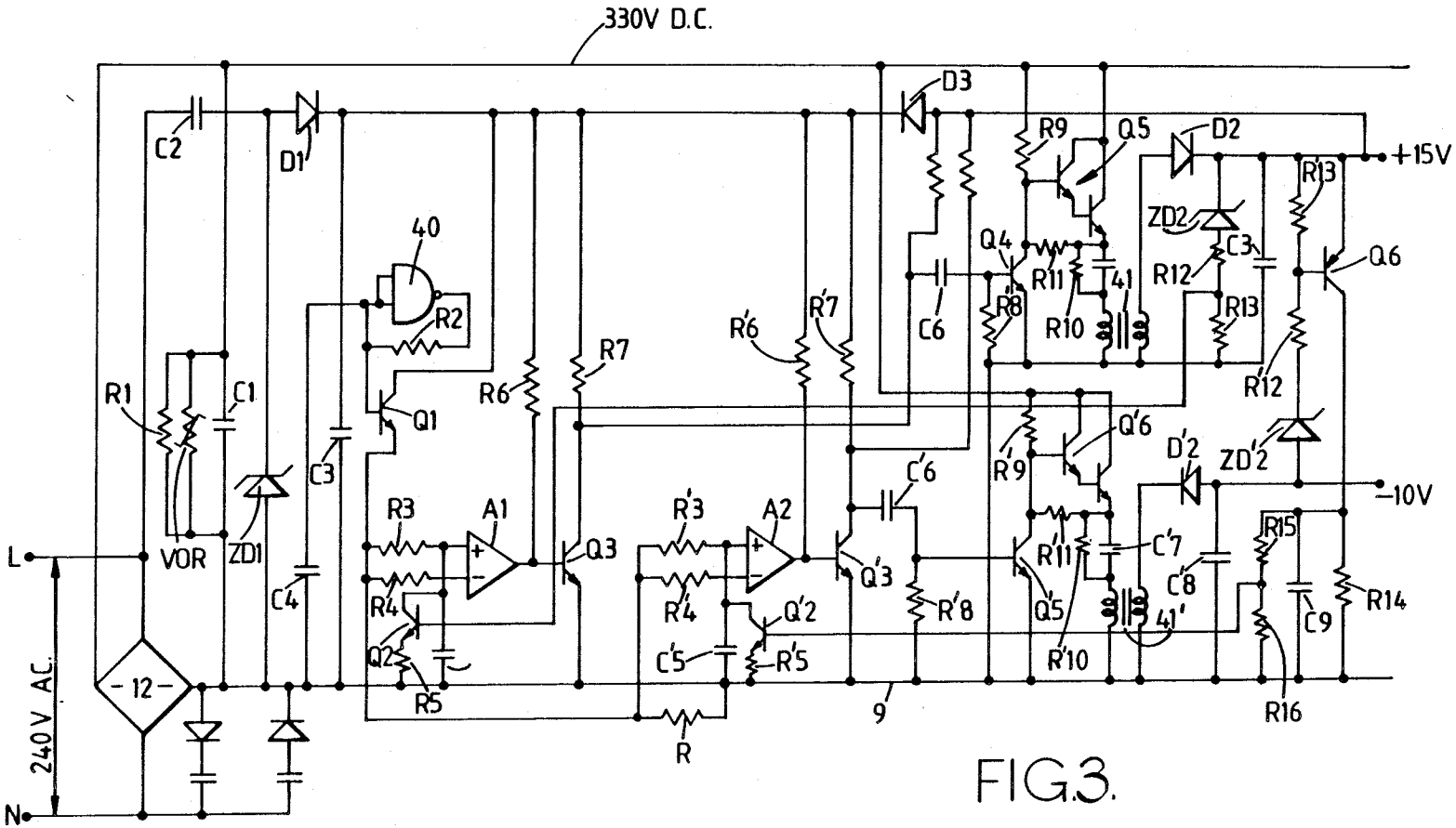
FIG. 3 is a circuit diagram of various power supply units forming part of the circuit of FIG. 1.

The power supply circuits of FIG. 1 are shown in detail in FIG. 3. The power rectifier 12 is a bridge rectifier which provides an output voltage of about 330 V between a supply rail 8 and a return rail 9. A surge prevention circuit consisting of a resistor $R_1$, a voltage dependent resistor VDR and a capacitor $C_1$ in parallel is connected across this output. The 15 volt supply 18 consists simply of a coupling capacitor $C_2$, a 15 volt zener diode $ZD_1$, a diode $D_1$ and a capacitor $C_3$.

The two switch mode power supplies 16 and 17 are driven by a common oscillator comprising a single CMOS NAND gate 40 with its two inputs connected together, a feedback resistor $R_2$ and a capacitor $C_4$ connecting these inputs to rail 9. An npn transistor $Q_1$ connected as a voltage follower and having an emitter load resistor R, buffers the voltage signal on the capacitor $C_4$ and provides the output of the oscillator.

This output is supplied to two comparators $A_1$ and $A_2$ included in the two switch mode power supplies 16, 17. Comparator $A_1$ has its input terminals connected by respective resistors $R_3$, $R_4$ to the oscillator output. The non-inverting input is connected by a capacitor $C_5$ to rail 9 and is also connected to the collector of an npn transistor $Q_2$ which has its emitter connected to rail 9 by a resistor $R_5$. The output of comparator $A_1$ is connected by a pull-up resistor $R_6$ to the cathode of diode $D_1$ and is also connected to the base of an npn transistor $Q_3$, which has its emitter connected to rail 9. The transistor $Q_3$ has a collector load resistor $R_7$ and its collector is also coupled by a capacitor $C_6$ to the base of an npn resistor $Q_4$ which has its emitter connected to rail 9. A resistor $R_8$ connects the base of transistor $Q_4$ to rail 9 and a further resistor $R_9$ connects the collector thereof to the 330 V d.c. supply conductor. An npn Darlington pair $Q_5$ has its common collector connected to the 330 V d.c. supply, its base connected to the collector of transistor $Q_4$ and its emitter connected via a capacitor $C_7$ and resistor $R_{10}$, in parallel, to one end of the primary winding of a transformer 41, the other end of this primary winding being connected to rail 9. A resistor $R_{11}$ connects the emitter of the Darlington pair $Q_5$ to the collector of the transistor $Q_4$.

The secondary winding of the transformer 41 has one end connected to rail 9 and the other end connected to the anode of a diode $D_2$. A 15 V zener diode $ZD_2$ has its cathode connected to the cathode of diode $D_2$ and its anode connected to rail 9 via two resistors $R_{12}$, $R_{13}$ in series and the junction of these resistors is connected to the base of the $Q_2$ to provide voltage feedback around the power supply. A reservoir capacitor $C_8$ is connected between the cathode of diode $D_2$ and rail 9.

The feedback circuit provided by the zener diode $ZD_2$ and the transistor $Q_2$ operates to maintain the mark-space ratio of the output of the comparator $A_1$ at a level sufficient to provide the required output voltage at the cathode of diode $D_2$. Any increase in load current which will cause the voltage on capacitor $C_8$ to start to fall will be automatically adjusted by a corresponding increase in the mark to space ratio resulting from the increased conduction of the transistor $Q_2$.

The −10 V switch mode power supply is of similar design and includes components $R'_3$ to $R'_{11}$, $C'_5$ to $C'_8$, $Q'_2$ to $Q'_5$, 41', and $D'_2$ corresponding precisely to the correspondingly referenced components in the +15 V d.c. switch mode power supply, except that the diode $D'_2$ is reversed to provide a negative voltage on capacitor $C'_8$. The feedback circuit in this case, however, includes a zener diode $ZD'_2$ which has its anode connected to the anode of the diode $D'_2$ and its cathode connected by two resistors $R'_{12}$, $R'_{13}$ in series to the cathode of diode $D_2$. The zener diode $ZD'_2$ has a 24 V breakdown voltage. A pnp transistor $Q_6$ has its emitter connected to the cathode of diode $D_2$ and its collector connected by a resistor $R_{14}$ and a capacitor $C_9$, in parallel, to rail 9. Two resistors $R_{15}$, $R_{16}$ are connected in series across the capacitor $C_9$ and their junction is connected to the base of transistor $Q'_2$. This arrangement provides for the mark-space ratio of the output of the comparator to be increased if the voltage at the anode of diode $D'_2$ tends to rise as a result of increased current being drawn.

FIG. 3 also shows a diode $D_3$ which connects the output of the 15 V d.c. switch mode power supply to the cathode of $D_1$, so that the simple zener diode shunt regulator 15 V d.c. supply is only needed at start up or if the switch mode power supply output voltage falls during use for any reason.

Figure 4:
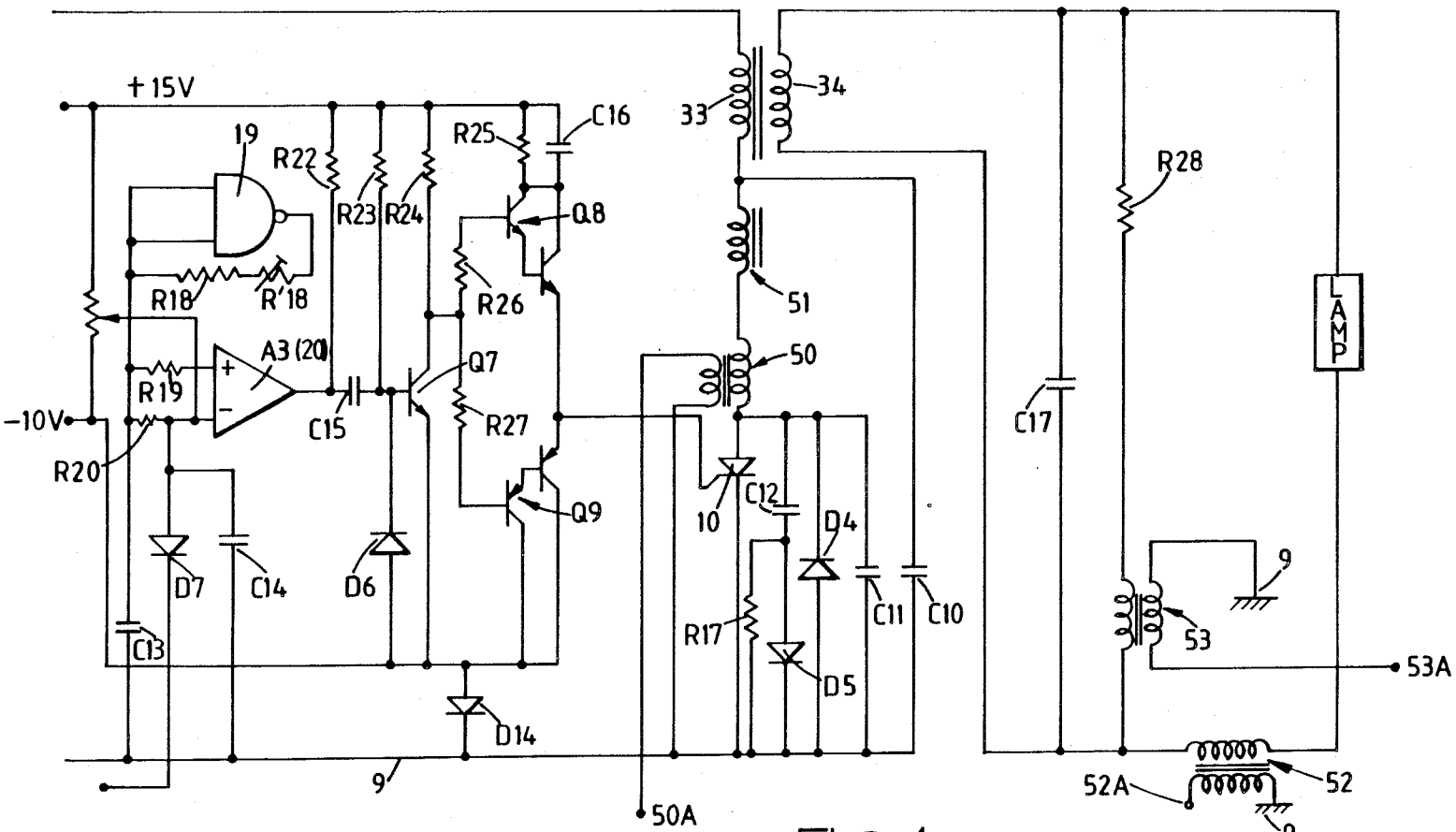
FIG. 4 is a circuit diagram showing an oscillator, comparator and drive circuit forming part of FIG. 1.

FIG. 4 shows in detail the lamp circuit, the series resonant circuit, the driver for the GTO and the control for the driver shown in FIG. 1 and described in general terms above. The GTO 10 has its cathode connected to rail 9 and its anode connected via a series circuit consisting of the primary winding of a GTO current detector transformer 50, an inductor 51 and the primary winding 33 of the main transformer. The inductor 51 may be of similar design to the main transformer, except that it is also formed of resin bonded iron powder. It may typically have an inductance of 1.3 mH. The interconnection of the inductor 51 and the primary winding 33 is connected by a capacitor $C_{10}$, typically of about 10 nF capacitance, to rail 9. The anode of the GTO 10 is connected by another capacitor $C_{11}$, typically of about 1nF capacitance, to rail 9. A diode $D_4$ has its cathode connected to anode of GTO 10 and its anode connected to rail 9 and a snubber circuit, consisting of a capacitor $C_{12}$ in series with the parallel combination of a resistor $R_{17}$ and a diode $D_5$ also connects the anode of GTO 10 to rail 9. The dominant components which determine the resonant frequency of the circuit described above are the inductor 51 and the capacitor $C_{10}$.

The oscillator 19 of FIG. 1 is of similar construction to that used to drive the power supplies, that is to say it includes a single CMOS NAND gate with a feedback resistor ($R_{18}$ and $R'_{18}$ in series) and a capacitor $C_{13}$ connecting the gate input to rail 9. The comparator 20 includes an integrated circuit voltage comparator $A_3$ which has its inputs connected by resistors $R_{19}$ and $R_{20}$ respectively to the oscillator output. The non-inverting input of comparator $A_3$ is connected to a reference voltage source, such as the slider of a potentiometer $R_{21}$ connected between the +15 V and −10 V d.c. supply rails. A capacitor $C_{14}$ connects the inverting input of comparator $A_3$ to rail 9.

The output of amplifier $A_3$ is connected by a pull-up resistor $R_{22}$ to the +15 V supply rail and by a capacitor $C_{15}$ to the base of an npn transistor $Q_7$ which has its emitter connected to the −10 V supply rail. A resistor $R_{23}$ connects the base of transistor $Q_7$ to the +15 V supply rail and a diode $D_6$ has its cathode connected to the base of transistor $Q_7$ and its anode connected to the −10 V supply rail. A resistor $R_{24}$ connects the collector of the transistor $Q_7$ to the +15 V supply rail.

The collector of transistor $Q_7$ is connected to drive a push-pull output stage of the driver circuit. This output stage comprises an npn Darlington pair $Q_8$ and a pnp Darlington pair $Q_9$ with their emitters connected together and to the GTO gate. The collectors of Darlington pair $Q_8$ are connected by a resistor $R_{25}$ and a capacitor $C_{16}$, in parallel, to the +15 V rail and those of the Darlington pair $Q_9$ are connected directly to the −10 V rail. The bases of the two Darlington pairs are connected by respective resistors $R_{26}$, $R_{27}$ to the collector of transistor $Q_7$.

The output of the oscillator 19 is a triangular wave of frequency determined by the values of resistor $R_{18}$ and capacitor $C_{13}$. Ignoring for the moment a diode $D_7$ which is connected to the inverting input of comparator $A_3$, the output of $A_3$ is low whenever the oscillator output voltage is less than the reference voltage on the slider of potentiometer $R_{21}$ and goes high while the oscillator output is higher than this reference voltage. Resistor $R_{23}$ biases transistor $Q_7$ on, but transistor $Q_7$ is turned off when the output of the comparator $A_3$ goes low. This causes the GTO 10 to be turned on. The variable resistor $R'_{18}$ is adjusted to set the oscillator frequency to be substantially the same as the resonant frequency of the series resonant circuit and the resistor $R_{21}$ is set to provide the maximum required mark to space ratio of the circuit.

The diode $D_7$ is connected to the feedback and control circuit and can only cause the reference voltage at the inverting input of comparator $A_3$ to be reduced, thereby reducing the mark-space ratio and reducing the power transferred to the lamp. The comparator $A_3$ can, in fact be completely inhibited by drawing sufficient current via the diode $D_7$ as will be hereinafter explained.

The secondary winding 34 of the main transformer has a capacitor $C_{17}$ connected across it. The lamp is connected in series with the primary winding of a current sensing transformer 52 across the secondary winding 34. Also connected across winding 34 is a voltage sensing circuit comprising a transformer 54 and a resistor $R_{28}$, the resistor being in series with the primary winding of the transformer 54. The secondary winding of each of the transformers 50, 53 and 54 is connected to rail 9 at one end, the other end (50*a*, 52*a*, 53*a*)being connected to the feedback and control circuits shown in detail in FIGS. 5 and 6.

Figure 5:
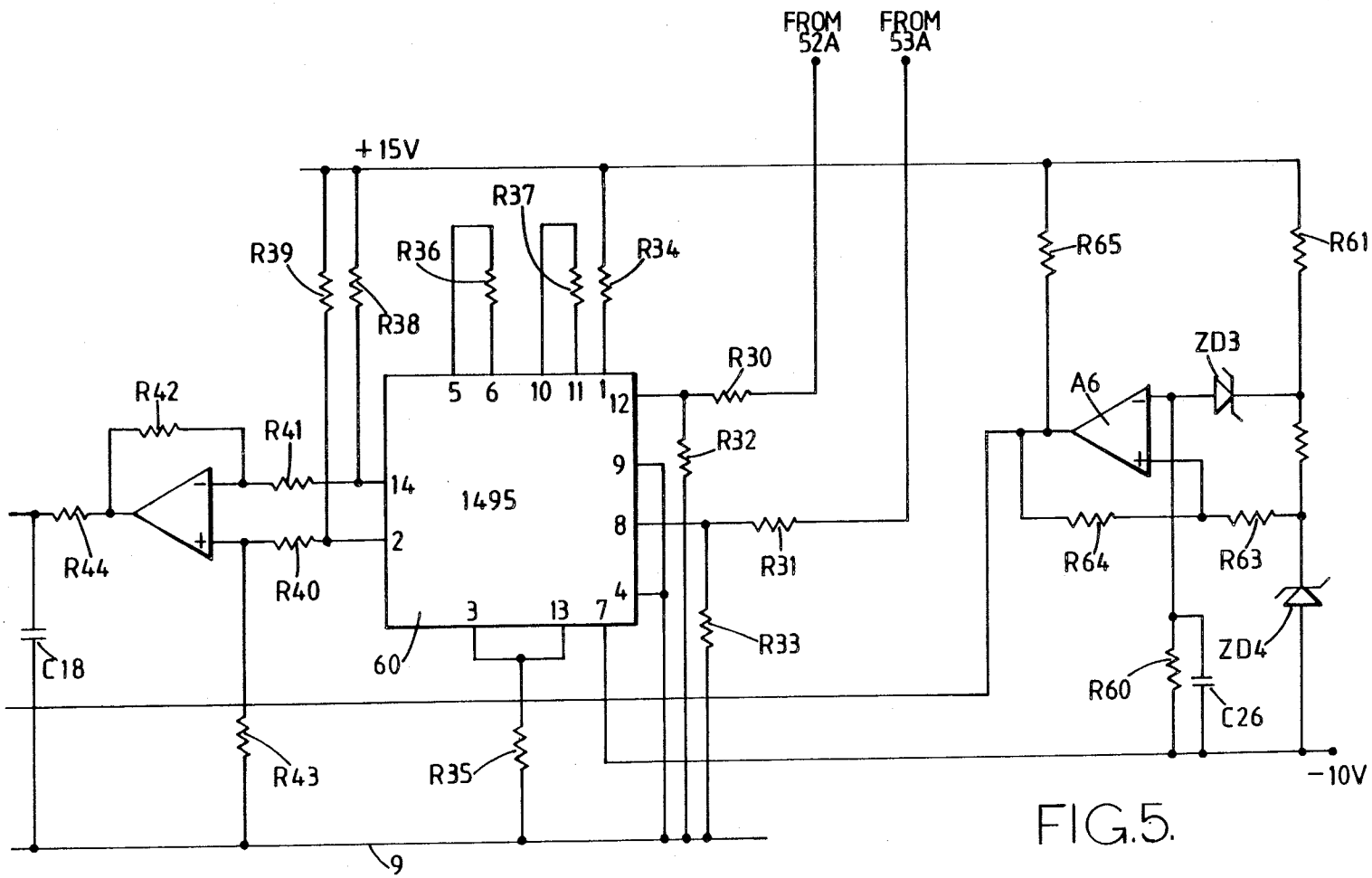
FIGS. 5 and 6 are two parts of a feedback and control circuit.

Turning firstly to FIG. 5, it will be noted that the circuit includes a four quadrant analog multiplier integrated circuit 60. The outputs of the two transformers 52 and 53 are connected via respective resistors $R_{30}$, $R_{31}$, to the +X and +Y inputs of the circuit 60, these inputs being connected to rail 9 via respective resistors $R_{32}$, $R_{33}$. The −X and −Y inputs of circuit 60 are connected to rail 9. The supply input (pin 1) of circuit 60 is connected by a resistor $R_{34}$ to the +15 V supply and pins 3 and 13 thereof are connected together and connected to rail 9 by a resistor $R_{35}$. Pins 5 and 6 are interconnected by a resistor $R_{36}$ and pins 10 and 11 are interconnected by a resistor $R_{37}$ (as is conventional). Pin 7 is connected to the −10 V supply. The output of circuit 60 appears across its pins 2 and 14 and these pins are connected by respective pull-up resistors $R_{38}$, $R_{39}$ to the +15 V supply and by respective resistors $R_{40}$ and $R_{41}$ to the respective non-inverting and inverting inputs of an operational amplifier $A_4$ connected as a differential amplifier with a gain of about 50. A feedback resistor $R_{42}$ connects the output of amplifier $A_4$ to its inverting input and a resistor $R_{43}$ connects the non-inverting input of amplifier $A_4$ to rail 9. The output of amplifier $A_4$ is connected by a resistor $R_{44}$ to the anode of a diode $D_8$ (see FIG. 6) which is also connected to rail 9 by a capacitor $C_{18}$. The output of amplifier $A_4$ is proportional to the instantaneous value of the power consumed by the lamp 13 as the multiplier circuit multiplies signals represent the lamp voltage and current respectively. Resistor $R_{44}$ and capacitor $C_{18}$ effectively remove the a.c. components of the signal at the output of amplifier $A_4$ and leave a d.c. signal representing the "average" power consumption of the lamp. Typically the resistor 44 and capacitor $C_{18}$ have a time constant of about 1 mS.

Figure 6:
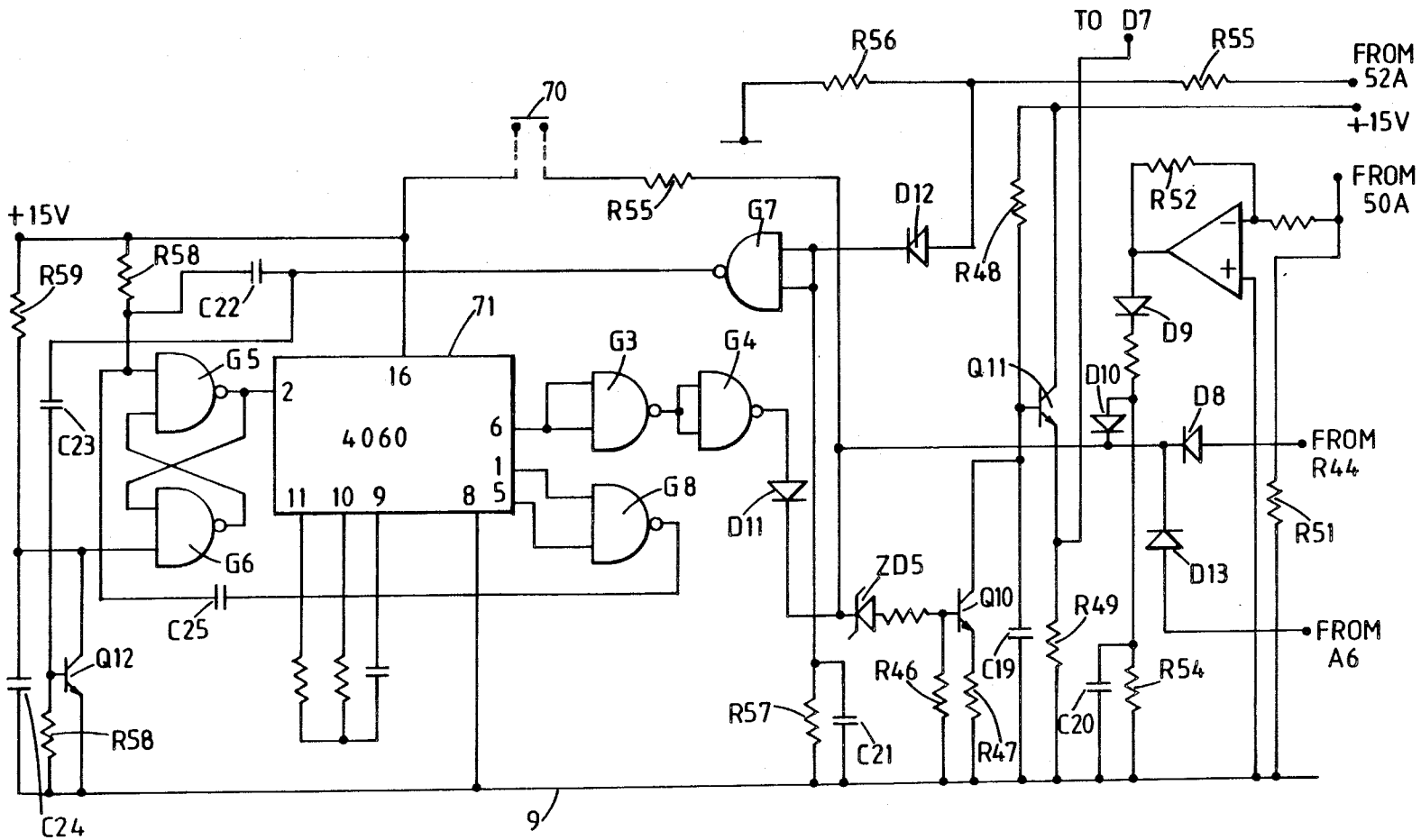

Turning now to FIG. 6, the cathode of diode $D_8$ is connected to the cathode of a 6.8 V zener diode $ZD_2$ which has its anode connected by two resistors $R_{45}$, $R_{46}$ in series to rail 9. The interconnection of these two resistors is connected to the base of an npn transistor $Q_{10}$ which has its emitter connected to rail 9 by a resistor $R_{47}$. The collector of transistor $Q_{10}$ is connected by a resistor $R_{48}$ to the +15 V supply and by a capacitor $C_{19}$ to rail 9. The resistor $R_{48}$ provides a charging circuit for the capacitor $C_{19}$ which circuit has a time constant of about 2 seconds. The resistor $R_{47}$ and transistor $Q_{10}$ provide a discharge path with a time constant of about 0.2 seconds.

An npn transistor $Q_{11}$ is provided as a voltage follower to buffer the voltage on the capacitor $C_{10}$. The emitter of transistor $Q_{11}$ is connected by a resistor R49 to rail 9 and its collector is connected directly to the +15 V supply. The emitter of transistor $Q_{11}$ is connected directly to the cathode of the diode $D_7$.

The circuit described above constitutes the main control loop for regulating the lamp power. It will be understood that any tendency for the lamp power to increase will result in the voltage on capacitor $C_{18}$ rising. This will turn transistor $Q_{10}$ on causing the voltage on capacitor $C_{19}$ to start to fail, which in turn will reduce the mark-space ratio of the output of the amplifer $A_3$ and will thereby reduce the power consumed. Conversely, any tendency for the lamp power to decrease will result in the charge on capacitor $C_{19}$ increasing so that the mark-space ratio is increased. It should be noted that increase of the mark-space ratio is allowed to occur at a slower rate than decrease thereof.

The output of the transformer 50 is applied via a resistor $R_{50}$ to the inverting input terminal of an operational amplifier $A_5$ and by a resistor $R_{51}$ to rail 9. A feedback resistor $R_{52}$ connects the output of amplifier $A_5$ to its inverting input. The output of amplifier $A_5$ is connected to the anode of a diode $D_9$, the cathode of which is connected by a resistor $R_{53}$ to one terminal of a capacitor $C_{20}$ the other terminal of which is connected to rail 9. A resistor $R_{54}$ is connected across capacitor $C_{20}$. The resistor $R_{53}$ provides a charging path for capacitor $C_{20}$ having a time-constant of about 0.2 mS, whereas the resistor $R_{54}$ provides a discharge path having a time constant of about 10 mS, so that the capacitor $C_{20}$ operates as a peak store and the voltage across it corresponds to the peaks in the current waveform in the inductor 51.

A diode $D_{10}$ connects the first-mentioned terminal of the capacitor $C_{20}$ to the cathode of zener diode $ZD_2$ so that, should the peak current referred to rise above a predetermined level, such that the voltage on capacitor $C_{20}$ is higher than reverse breakdown voltage of zener diode $ZD_2$, the mark-space ratio will be overridingly reduced to protect the GTO from damage by an excessive current level.

The circuit shown in the left hand half of FIG. 6 controls starting of the system. This includes a push-button switch 70 which connects the +15 V supply to the cathode of zener diode $ZD_2$ via a resistor R. Closure of this switch forces the transistor $Q_{10}$ to turn on, discharging capacitor $C_{19}$ and turning the lamp driver circuit completely off.

A CMOS oscillator/timer circuit 71, which is a type 4060 CMOS integrated circuit is connected so as, when enabled, to provide a drive signal via cascaded NAND gates $G_3$ and $G_4$, for 45 seconds in every successive 60 seconds. This drive signal is applied via a diode $D_{11}$ to the cathode of the zener diode $ZD_5$, thereby to disable the lamp driver circuit. The circuit 71 is enabled and disabled under the control of a flip-flop circuit consisting of two cross-connected NAND gates $G_5$, $G_6$. This flip-flop is set when power is first applied to the circuit, and reset either when the current detected by transformer 52 rises to a level that the lamp has ignited or after a period of about 15 minutes has elapsed. To this end, the output of transformer 52 is applied via a resistive potential divider $R_{55}$, $R_{56}$, and a diode $D_{12}$ to the inputs of a NAND gate $G_7$. A resistor $R_{57}$ and a capacitor $C_{21}$ in parallel connect the inputs of gate $G_7$ to rail 9. The output of gate $G_7$ is connected by a capacitor $C_{22}$ to one input of gate $G_5$, which a resistor $R_{58}$ connects to the +15 V supply, and by a capacitor $C_{23}$ to the base of an npn transistor $Q_{12}$. A resistor $R_{58}$ connects the base of transistor $Q_{12}$ to rail 9. The emitter of transistor $Q_{12}$ is connected to rail 9 and its collector is connected to one input of the gate $G_6$. A resistor $R_{59}$ connects this input of gate $G_6$ to the +15 V supply and a capacitor $C_{24}$ connects it to rail 9. A NAND gate $G_8$ has its inputs connected to output pins 1 and 5 of the circuit 61 and its output connected by a capacitor $C_{25}$ to said one input of gate $G_5$.

At power-up, the output of gate $G_8$ is high, but the input of gate $G_6$ is held low momentarily by the capacitor $C_{24}$, so that the flip-flop is set with the output of gate $G_5$ low and that of gate $G_6$ high. If the output of gate $G_7$ goes low at any stage it will cause the flip-flop to be reset, by driving one input of $G_5$ low momentarily. If the output of gate $G_7$ subsequently goes high because discharge through the lamp has been interrupted (for example via the switch 70), the flip-flop will be set again, via the transistor $Q_{12}$ pulling down one input of the gate $G_6$.

Should the 15 minute interval elapse while the output of gate $G_7$ remains high, the output of gate $G_8$ will go low, the input to gate $G_5$ will be pulled down and the flip-flop will reset irrevocably until the power supply to the system is interrupted and then re-connected.

Returning now to FIG. 5, an operational amplifier $A_6$ is provided. This has its inverting input connected by a resistor $R_{60}$ and a capacitor $C_{26}$ in parallel to the −10 V supply. The inverting input is also connected to the anode of a 5 V zener diode $ZD_3$, which has its cathode connected to the junction of two resistors $R_{61}$ and $R_{62}$ connected in series between the +15 V supply and the cathode of a 10 V zener diode $ZD_4$ having its anode connected to the −10 V rail. The cathode of this zener diode is connected by a resistor $R_{63}$ to the non-inverting input of amplifier $A_6$, which input is also connected by a feedback resistor $R_{64}$ to the output of amplifier $A_6$. A pull-up resistor is connected between the output of amplifier $A_6$ and the +15 V supply.

The resistor $R_{61}$ and $R_{62}$ are of equal ohmic value so that normally their junction stands at +7.5 V and the inverting input of amplifier $ZD_3$ is held at +2.5 V, whilst the non-inverting input is held at 0 V so that the output is set to 0 V and the circuit has no effect. In the event of either switch mode psu 16, 17 failing to the extent that the total voltage between the two supply conducts is less than about 20 V then the voltage at the inverting input will become lower than that at the non-inverting input and the output of amplifer $A_6$ will go high.

The output of amplifier $A_6$ is connected by another diode $D_{13}$ (FIG. 6) to the cathode of zener diode and inhibits the lamp driver when high. Amplifier $A_6$ acts at switch-on to inhibit the driver until the two switch mode psus are in operation and also when either of the psus fails during running.

Turning back again to FIG. 4, a diode $D_{14}$ is connected between the −10 V supply and rail 9 to ensure that under no circumstances can the GTO be turned on when it should be turned off to ensure that the voltage on the −10 V rail can never be significant about earth.

Figure 7:
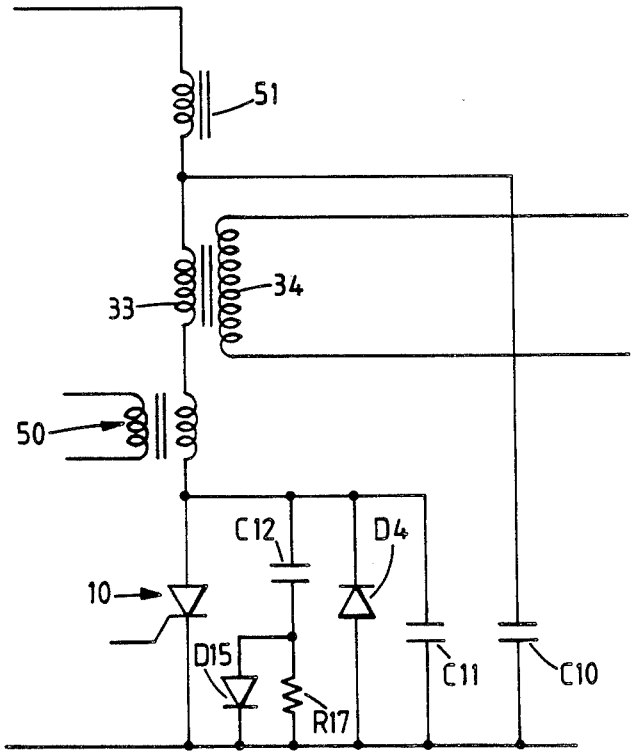
FIG. 7 is a view showing a modified form of series resonant circuit.

In the modified circuit shown in FIG. 7, the positions of the transformers 33, 34 and the inductor 51 in the series circuit are interchanged.

I claim:

1. A control gear for a high intensity gas discharge lighting tube, comprising an oscillator generating an oscillator frequency, drive means providing a drive signal exhibiting said oscillator frequency and a duty cycle ratio, a high speed switching element driven by said drive means, a transformer having its primary winding connected in a series resonant circuit tuned to the frequency of the oscillator and controlled by the switching element, and means for connecting the secondary winding of the transformer to the lighting tube.

2. A control gear as claimed in claim 1 in which the switching element is a gate turn-off thyristor (GTO).

3. A control gear as claimed in claim 2 wherein said drive means includes a driver circuit for the GTO gate for turning on the GTO and negative-going pulses thereto for turning it off.

4. A control gear as claimed in claim 3 in which said driver circuit includes a variable duty cycle ratio control means.

5. A control gear as claimed in claim 4 in which said variable duty cycle ratio control means includes means for setting the duty cycle ratio to an initial value to provide a high amplitude signal from the series resonant circuit so as to create a high voltage across the lamp for causing initial ionization of the gas herein.

6. A control gear as claimed in claim 5 further comprising a feedback circuit sensitive to the power consumed by the lamp for reducing said duty cycle ratio below said initial value and controlling the lamp power in a closed loop.

7. A control gear as claimed in claim 6 further comprising a GTO protection circuit including means sensitive to the peak current in the series resonant circuit and operating to override the closed loop and reduce the duty cycle ratio if such peak current exceeds a predetermined value.

8. A control gear as claimed in claim 6 further comprising first and second power supply units for supplying positive and negative voltages to said driver circuit, and a power supply monitor circuit sensitive to both voltages and operating to override said closed loop and reduce the duty cycle ratio to zero in the event of either of said power supply units becoming inoperative.

9. A control gear as claimed in claim 6 including a starting control circuit for alternately inhibiting and enabling the ratio control means, means sensitive to lamp current for disabling said starting control circuit on lighting of the lamp and time-out means for disabling the starting control circuit after a predetermined period has elapsed without lighting of the lamp having occurred.

10. A control gear as claimed in claim 1 in which said transformer comprises primary and secondary windings totally enclosed within a core having a sleeve portion and a spool shaped portion within said sleeve portion, said sleeve and spool shaped portions being formed of bonded iron powder.

11. A control gear as claimed in claim 1 in which said resonant circuit also includes an inductor which is separate from the transformer.

12. A control gear as claimed in claim 11 in which the primary winding of the transformer, the inductor and the switching element are connected in series, a capacitor is connected in parallel with the switching element, a further capacitor is connected across the series combination of the inductor and the switching element, and a diode connected across said first mentioned capacitor and arranged to conduct in the reverse direction to the switching element.

13. A control gear as claimed in claim 12 further comprising a snubber circuit connected across said switching element, said snubber circuit comprising a capacitor in series with the parallel combination of a resistor and a diode, said diode being arranged to conduct in the same direction as the switching element.

14. The control gear of claim 1, further comprised of said oscillator providing a frequency fixed independently of said switching element, transformer and series resonant circuit.

15. The control gear of claim 1, further comprised of said switching element being discrete from, but driven on and off by said oscillator at the frequency of the oscillator.

16. The control gear of claim 1, further comprised of electrical power being transferred to the lighting tube only via said primary and secondary windings of said transformer.

17. A control gear for a high intensity gas discharge lighting tube, comprising:

a control circuit having a switched side and a lamp side, and said switched side including:

an oscillator running at a fixed oscillator frequency, drive means providing a drive signal exhibiting said oscillator frequency and a variable duty cycle ratio, a switching element discrete from, and driven by said drive signal at said oscillator frequency, a series resonant circuit tuned to said oscillator frequency, transformer means having a primary winding connected in said series resonant circuit, and a secondary winding, for transferring power from said switched side to said lamp side of said circuit, and said lamp side including means for connecting said secondary winding of the transformer to a lighting tube.

18. The control gear of claim 17, further comprised of said oscillator providing said fixed oscillator frequency independently of said switching element, transformer and series resonant circuit.

19. The control gear of claim 17, further comprised of electrical power being transferred to the lighting tube only via said primary and secondary windings of said transformer.

20. The control gear of claim 17, wherein said control circuit further comprises a plurality of electrical conductors connectable across a source of electrical energy for powering said control gear, with said oscillator and said series resonant circuit separately coupled in parallel across said plurality of conductors.

* * * * *